US005637955A

United States Patent [19]

Ji

[11] Patent Number: 5,637,955

[45] Date of Patent: Jun. 10, 1997

[54] DEFLECTION YOKE FOR CATHODE-RAY TUBE COMPRISING A SEPARATOR MADE OUT OF FERRITE AND PLASTIC MATERIALS

[75] Inventor: Seong-hun Ji, Pusan, Rep. of Korea

[73] Assignee: Samsung Display Devices Co., Ltd., Kyungki-do, Rep. of Korea

[21] Appl. No.: 667,820

[22] Filed: Jun. 20, 1996

[30] Foreign Application Priority Data

Jun. 24, 1995 [KR] Rep. of Korea ..... 1995 17263

[51] Int. Cl.[6] ..... H01J 29/70; H01F 7/00; H01H 1/00; H01H 5/00

[52] U.S. Cl. ..... 313/440; 335/210; 335/213

[58] Field of Search ..... 313/413, 421, 313/430–31, 437, 440, 442–43; 335/210, 213, 297, 299

[56] References Cited

U.S. PATENT DOCUMENTS 5,105,120 4/1992 Nishioka et al. ..... 313/440
5,138,290 8/1992 Togane et al. ..... 313/440 X

*Primary Examiner*—Sandra L. O'Shea
*Assistant Examiner*—Mack Haynes
*Attorney, Agent, or Firm*—Leydig, Voit & Mayer

[57] ABSTRACT

An improved deflection yoke for a cathode ray tube includes a cone-shaped separator, a ferrite core on an outer surface of the separator, vertical deflection coils wound around the ferrite core, and horizontal deflection coils on an inner surface of the separator, wherein the separator is an anisotropic plastic magnetic body that shields harmful magnetic flux generated in deflection coils and prevents distortion of the magnetic flux so that electron beams can be effectively deflected.

9 Claims, 5 Drawing Sheets

DEFLECTION YOKE FOR CATHODE-RAY TUBE COMPRISING A SEPARATOR MADE OUT OF FERRITE AND PLASTIC MATERIALS

BACKGROUND OF THE INVENTION

The present invention relates to a deflection yoke for a cathode-ray tube and, more particularly, to a deflection yoke for a cathode-ray tube with an improved separator.

As shown in FIG. 1, a cathode-ray tube generally comprises a deflection yoke 1 positioned on a cone portion 2 between the neck 3, in which an electron gun 4 is installed, and a funnel portion 5 for selectively deflecting electron beams emitted from the electron gun 4. The deflected electron beams land on a fluorescent membrane on a panel 6, to thereby form a picture.

As shown in FIG. 2, the deflection yoke 10 of FIG. 1 is constituted by a cone-shaped separator 11, horizontal deflection coils 12 on the inner surface of the separator 11, and vertical deflection coils 14 wound around a ferrite core 13 on the outer surface of the separator 11.

When voltages are selectively applied to the horizontal coils 12 and the vertical coils 14, the conventional deflection yoke 10 generates a deflection magnetic field for deflecting electron beams emitted from the electron gun 4 of FIG. 1. However, because the separator 11 of the conventional deflection yoke 10 is composed of a plastic, the separator 11 permits magnetic flux of the horizontal deflection coils 12 to penetrate without being shielded, as shown in FIG. 3. Thus, a special shielding means is required to shield the harmful magnetic flux.

Moreover, the magnetic flux from the vertical deflection coils 14 supported by the separator 11 is partially distorted due to the method of winding the vertical deflection coils 14 around the ferrite core 13, thereby distorting the deflection of the electron beams.

SUMMARY OF THE INVENTION

The object of the present invention is to provide a deflection yoke for a cathode-ray tube considerably reducing the penetration of harmful magnetic flux outside, toward the separator, and preventing a rapid change in the magnetic flux density so that the electron beams can be deflected effectively.

To accomplish the above object, there is provided a deflection yoke for a cathode-ray tube comprising: a cone-shaped separator; a ferrite core on the outer surface of said separator; vertical deflection coils wound around said ferrite core; and hormonal deflection coils on the inner surface of said separator, wherein said separator is an anisotropic plastic magnetic body.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 5:
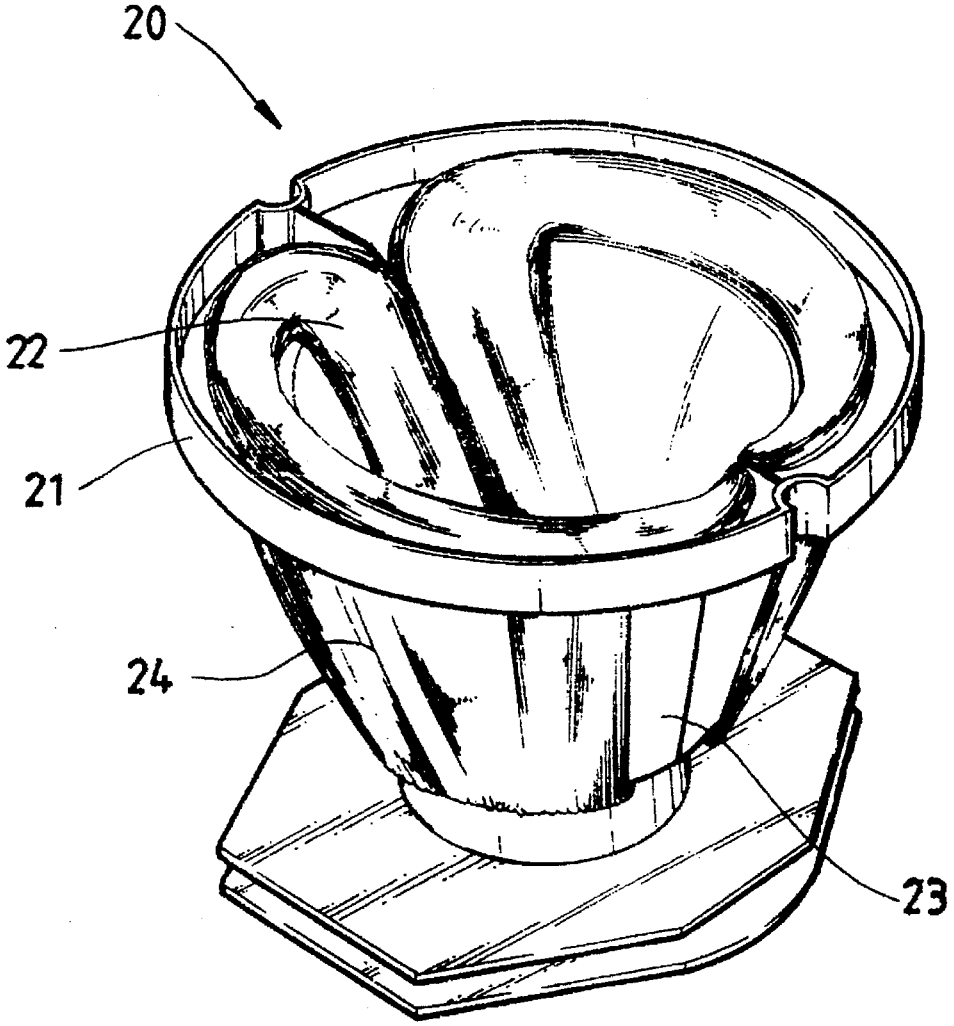
FIG. 5 is a perspective view showing a deflection yoke according to the present invention.

FIG. 5 shows a deflection yoke for a cathode-ray tube according to an embodiment of the present invention. As shown in FIG. 5, the deflection yoke 20 includes a cone-shaped separator 21, horizontal deflection coils 22 on the inner surface of the separator 21, and vertical deflection coils 24 wound around a ferrite core 23 on the outer surface of the separator 21.

Here, the separator 21 is an anisotropic plastic magnetic body. It is preferable that the anisotropic plastic magnetic body is made by mixing ferrite magnetic powder or a rare-earth magnet powder having a magnetization property with a molten plastic material which is a bonding agent and injection-molding the mixture. Here, barium ferrite ($BaO.6Fe_2O_3$) or strontium ferrite ($SrO.6Fe_2O_3$) can be used as the ferrite powder and a samarium-cobalt series such as $SmCo_5$ and $Sm_2Co_{17}$ can be used as the rare-earth magnetic powder. A thermosetting resin such as an epoxy resin, or a thermoplastic resin such as nylon and polyolefin can be used as the molten plastic material.

Figure 1:
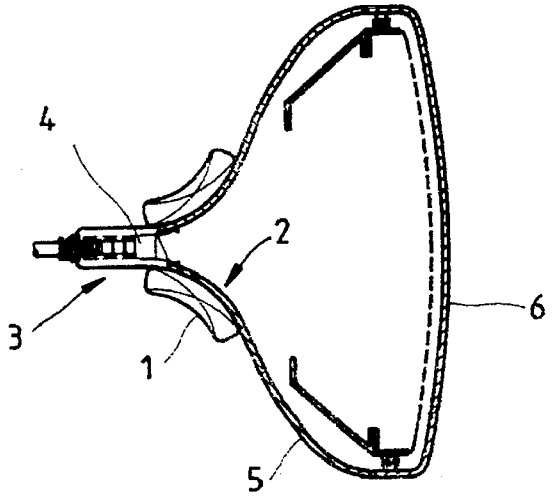
FIG. 1 shows a cross sectional view of a general cathode-ray tube.
Figure 2:
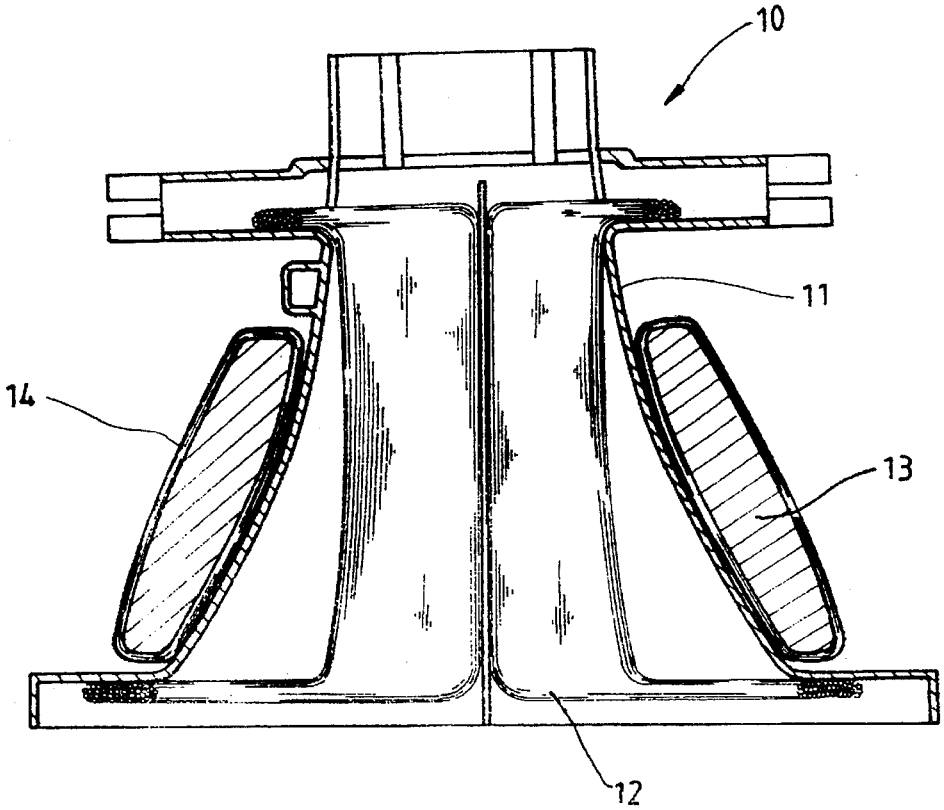
FIG. 2 (PRIOR ART)
FIG. 2 shows a cross sectional view of a conventional deflection yoke.
Figure 3:
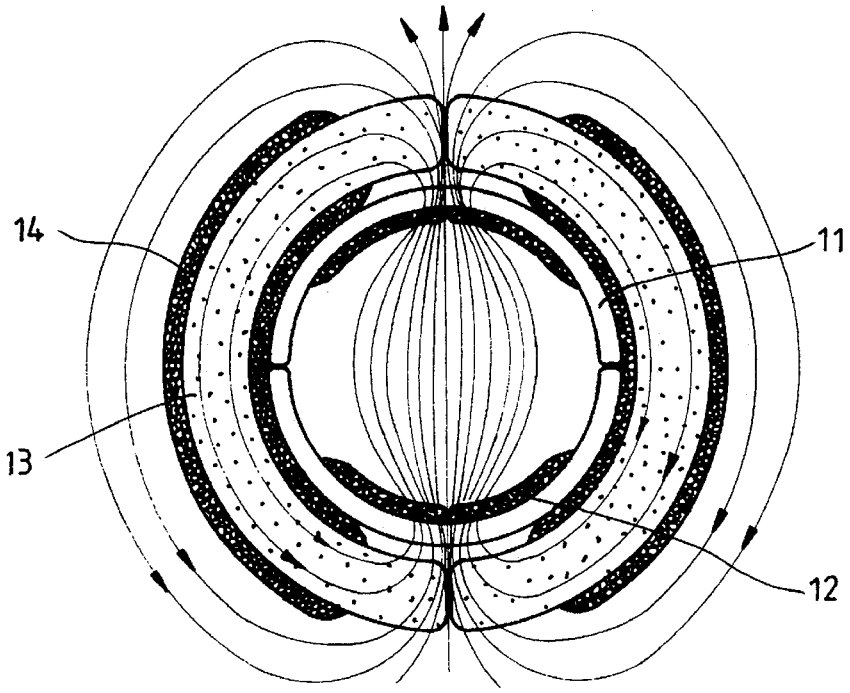
FIG. 3 (PRIOR ART)
FIG. 3 shows the magnetic flux produced by horizontal deflection coils of the conventional deflection yoke shown in FIG. 2.

In the deflection yoke 20 constructed as above, when a predetermined current selectively flows through the horizontal and vertical deflection coils 22 and 24 installed on the inner and outer surfaces of the separator 21 respectively, a magnetic field is generated inside and outside of the separator 21 by which electron beams emitted from the electron gun 4 of FIG. 1 is deflected.

Figure 6:
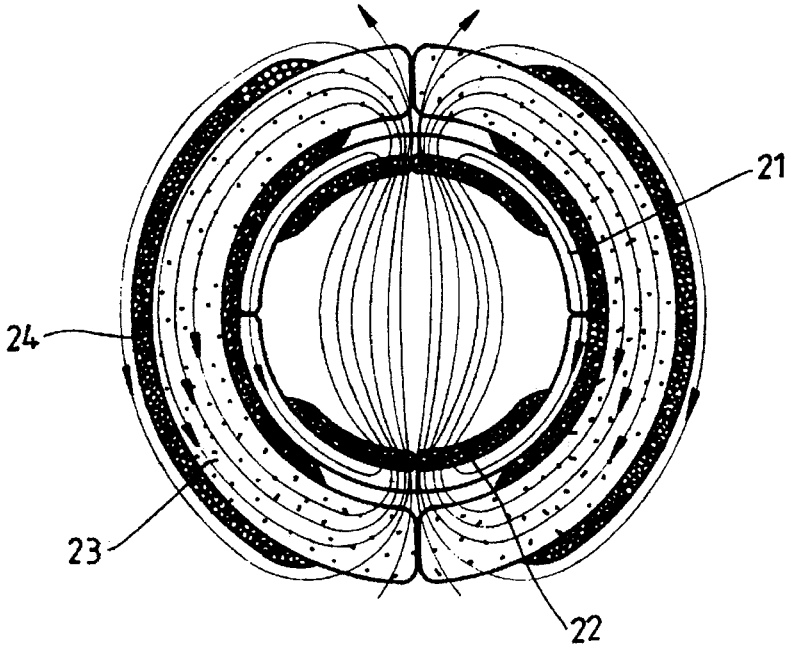
FIG. 6 shows the magnetic flux produced by horizontal deflection coils of the deflection yoke of the present invention.
Figure 4:
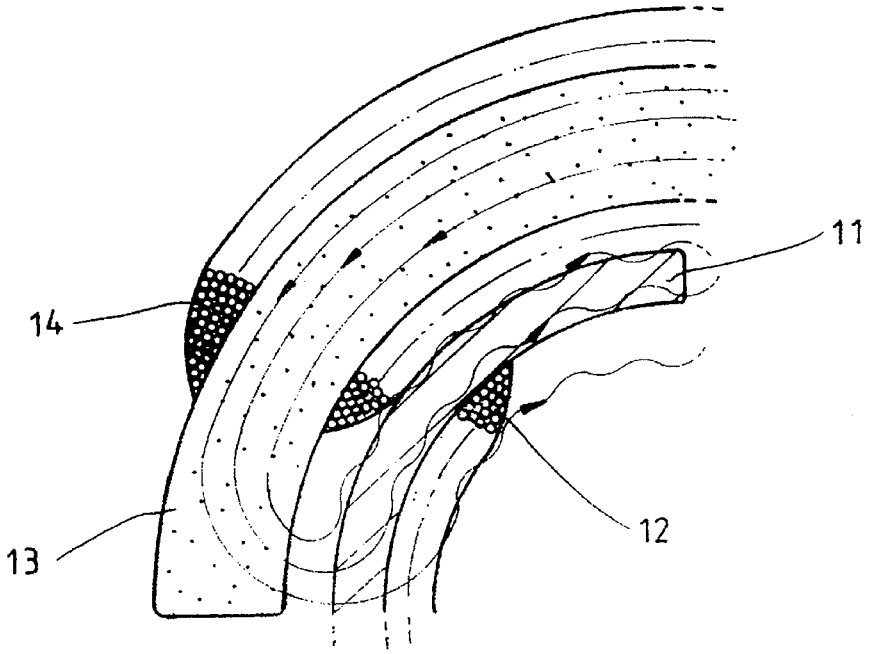
FIG. 4 (PRIOR ART)
FIG. 4 shows the magnetic flux produced by vertical deflection coils of the conventional deflection yoke shown in FIG. 2.

FIG. 6 shows a magnetic field formed by the horizontal deflection coils 22. Referring to FIG. 6, the flux in the horizontal magnetic field produced by the horizontal deflection coils 22 magnetizes the separator 21 formed of the anisotropic plastic magnetic material, and thus the magnetic dipole reverses direction. Then, the magnetized separator 21 generates a self-inducing magnetic field which offsets the harmful magnetic flux so that the flux does not extend outside the separator 21. Moreover, because the generated magnetic flux is distributed along the separator 21 made of a para-magnetic substance with high permeability in which the magnetic dipole is reversed in a frequency range, i.e., above 15 kHz, the flux density of the barrel-shaped horizontal magnetic field inside the separator 21 increases. Furthermore, because the separator 21 is made of a para-magnetic substance with high permeability, an external magnetic field such a terrestrial magnetic field is shielded and thus cannot penetrate into an effective deflection range.

Figure 7:
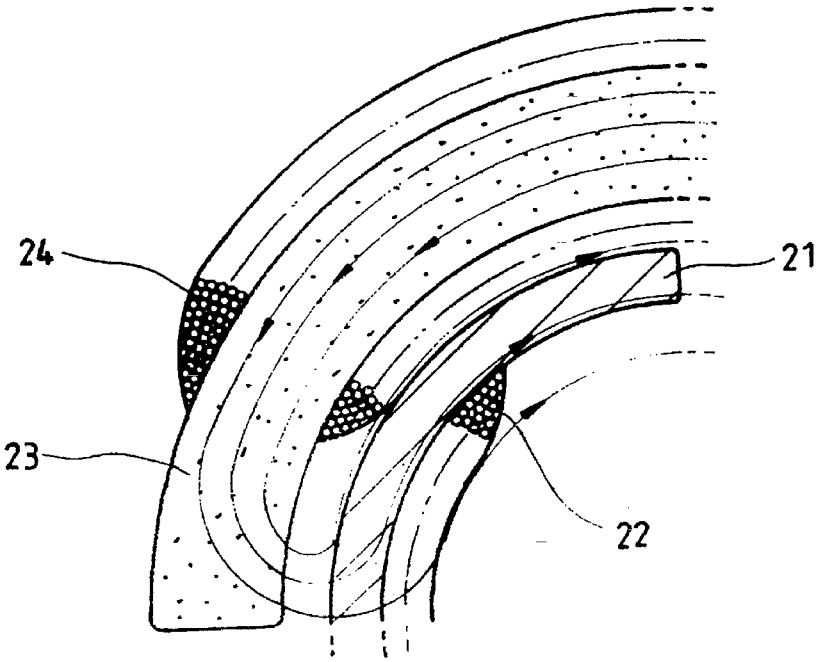
FIG. 7 shows the magnetic flux produced by vertical deflection coils of the deflection yoke of the present invention.

As shown in FIG. 7, the magnetic flux in the magnetic field formed by the vertical deflection coils 24 is distributed parallel to the separator 21 made of a magnetization magnetizable body. As a result, discrete distribution of the magnetic field appearing in the periphery due to the winding distribution of the coils is smoothed, reducing partial distortion of the magnetic flux.

Figure 8:
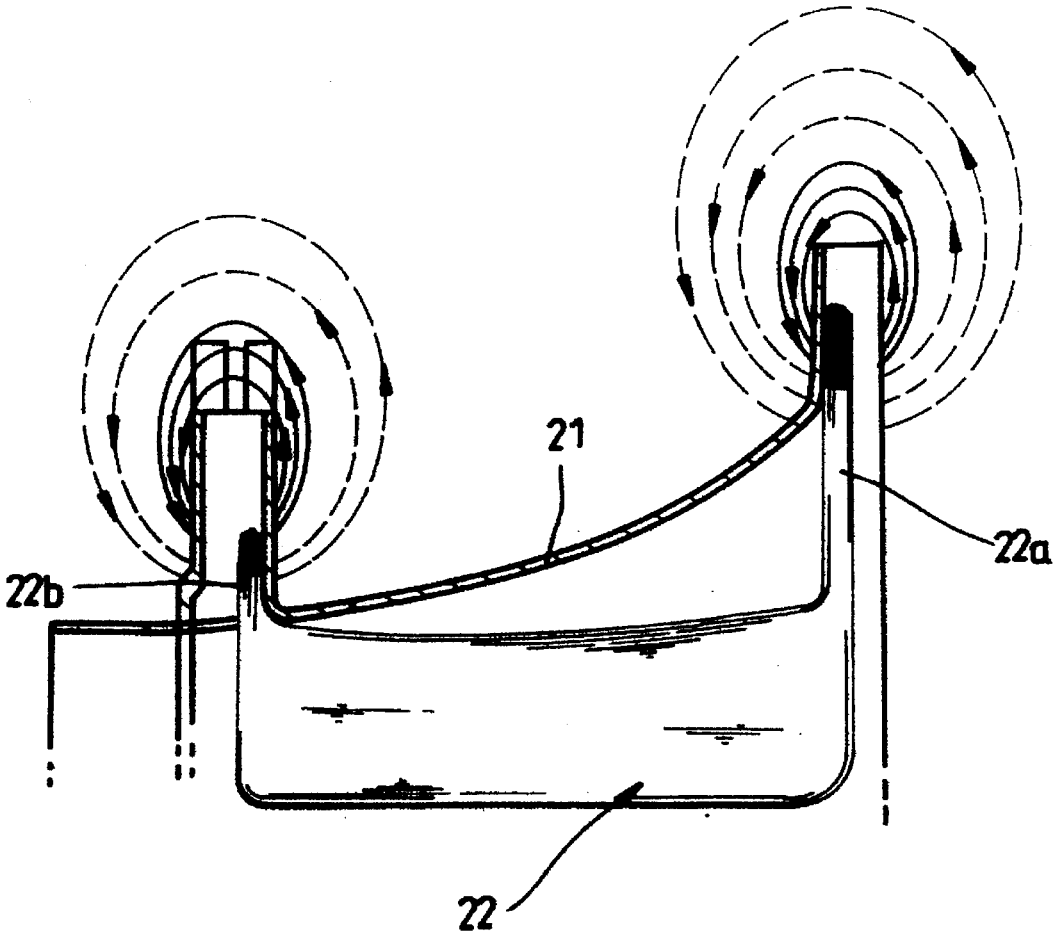
FIG. 8 is a cross-sectional view showing a deflection yoke according to the present invention.

Furthermore, as shown in FIG. 8, the separator 21 adopted in the present invention forms a self-inducing magnetic field (shown in bold), due to the flux of the horizontal deflection coils, and offsets the unnecessary high frequency magnetic flux (shown by dotted lines) generated by the coils 22*a* and 22*b* which are adjacent to the neck 21 of funnel 20 and the cone portion 22 without influencing deflection. Thus, effects due to the harmful high-frequency magnetic flux can be prevented.

As described above, the present invention considerably reduces the penetration of the harmful magnetic flux and prevents distortion of the magnetic flux by the deflection coils.

The deflection yoke described above according to the present invention is a mere embodiment, and it is clearly understood that any person skilled in the art can make variations and modifications within the scope of the appended claims.

What is claimed is:

1. A deflection yoke for a cathode-ray tube comprising:

a cone-shaped separator having inner and outer surfaces;

a ferrite core disposed on the outer surface of said separator;

vertical deflection coils wound around said ferrite core; and horizontal deflection coils disposed on the inner surface of said separator, wherein said separator is an anisotropic plastic magnetic body.

2. The deflection yoke for a cathode-ray tube claimed in claim 1, wherein said anisotropic plastic magnetic body includes a mixture of ferrite powder and a plastic material.

3. The deflection yoke for a cathode-ray tube claimed in claim 2, wherein said ferrite powder includes at least one of barium ferrite ($BaO.6Fe_2O_3$) and strontium ferrite ($SrO.6Fe_2O_3$).

4. The deflection yoke for a cathode-ray tube claimed in claim 3, wherein said plastic material is at least one selected from the group consisting of an epoxy resin, nylon, and polyolefin.

5. The deflection yoke for a cathode-ray tube claimed in claim 2, wherein said plastic material s at least one selected from the group consisting of an epoxy resin, nylon, and polyolefin.

6. The deflection yoke for a cathode-ray tube claimed in claim 1, wherein said anisotropic plastic magnetic body includes a rare-earth magnetic powder and a plastic material.

7. The deflection yoke for a cathode-ray tube claimed in claim 6, wherein said rare-earth magnetic powder is a samarium-cobalt compound selected from the group consisting of $SmCo_5$ and $Sm_2Co_{17}$.

8. The deflection yoke for a cathode-ray tube claimed in claim 7, wherein said plastic material is at least one selected from the group consisting of an epoxy resin, nylon, and polyolefin.

9. The deflection yoke for a cathode-ray tube claimed in claim 6, wherein said plastic material is at least one selected from the group consisting of an epoxy resin, nylon, and polyolefin.

* * * * *